US011905636B2

(12) United States Patent
Zattin et al.

(10) Patent No.: US 11,905,636 B2
(45) Date of Patent: Feb. 20, 2024

(54) LAUNDRY SOFTENER DISPENSING IN LAUNDRY MACHINES

(71) Applicant: Electrolux Appliances Aktiebolag, Stockholm (SE)

(72) Inventors: Andrea Zattin, Porcia (IT); Martino Bondi, Porcia (IT); Elisa Stabon, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 187 days.

(21) Appl. No.: 17/605,674

(22) PCT Filed: Apr. 16, 2020

(86) PCT No.: PCT/EP2020/060782
§ 371 (c)(1),
(2) Date: Oct. 22, 2021

(87) PCT Pub. No.: WO2020/221601
PCT Pub. Date: Nov. 5, 2020

(65) Prior Publication Data

US 2022/0213633 A1 Jul. 7, 2022

(30) Foreign Application Priority Data

Apr. 30, 2019 (EP) ..... 19171927

(51) Int. Cl.
*D06F 33/38* (2020.01)
*D06F 33/37* (2020.01)
(Continued)

(52) U.S. Cl.
CPC ..... *D06F 33/38* (2020.02); *D06F 33/37* (2020.02); *D06F 39/022* (2013.01);
(Continued)

(58) Field of Classification Search
CPC ..... D06F 33/37; D06F 33/38; D06F 39/022
See application file for complete search history.

(56) References Cited

U.S. PATENT DOCUMENTS 6,456,202 B2 * 9/2002 Johannsen ..... B01J 49/85 340/623
2018/0073177 A1 3/2018 Zattin et al.

FOREIGN PATENT DOCUMENTS

EP 3252199 A1 12/2017

OTHER PUBLICATIONS

International Search Report and Written Opinion for International Application No. PCT/EP2020/060782, dated Jun. 2, 2020, 9 pages.

* cited by examiner

*Primary Examiner* — Michael E Barr
*Assistant Examiner* — Kevin G Lee
(74) *Attorney, Agent, or Firm* — Bradley Arant Boult Cummings LLP

(57) ABSTRACT

A method for operating a laundry machine having a rotatable drum a tub enclosing said drum; a water supply; a control unit a laundry treatment agent dispensing device configured to hold and deliver at least one of a laundry detergent and a laundry softener; and a control system configured to provide a softener signal that alternately assumes a first value indicating that no laundry softener will be delivered, and a second value indicating that laundry softener will be delivered. The method comprises: performing a washing phase in which detergent is delivered into the tub; and performing a number of rinsing phases wherein detergent from the washing phase is removed using water from said water supply apparatus, wherein the control unit sets the number of rinsing phases according to whether the softener signal assumes the first value or the second value.

15 Claims, 7 Drawing Sheets

(51) Int. Cl.

| | |
|---|---|
| ***D06F 39/02*** | (2006.01) |
| *D06F 105/42* | (2020.01) |
| *D06F 101/06* | (2020.01) |
| *D06F 105/52* | (2020.01) |
| *D06F 103/06* | (2020.01) |
| *D06F 101/20* | (2020.01) |
| *D06F 103/22* | (2020.01) |
| *D06F 105/02* | (2020.01) |

(52) U.S. Cl.

CPC ..... *D06F 2101/06* (2020.02); *D06F 2101/20* (2020.02); *D06F 2103/06* (2020.02); *D06F 2103/22* (2020.02); *D06F 2105/02* (2020.02); *D06F 2105/42* (2020.02); *D06F 2105/52* (2020.02)

LAUNDRY SOFTENER DISPENSING IN LAUNDRY MACHINES

This application is a U.S. National Phase application of PCT International Application No. PCT/EP2020/060782, filed Apr. 16, 2020, which claims the benefit of European Application No. 19171927.7, filed Apr. 30, 2019, both of which are incorporated by reference herein.

FIELD OF THE INVENTION

The present invention generally relates to the field of laundry treatment machines (hereinafter, concisely, "laundry machines"), and particularly to laundry machines for treating, e.g. washing, items (such as linen, clothes, garments, shoes, and the like), such as laundry washing machines and laundry washing machines also implementing laundry drying functions (also referred to as washers/dryers). More particularly, the present invention relates to a laundry machine with an improved rinsing system and to a corresponding method for treating laundry.

BACKGROUND OF THE INVENTION

According to known techniques, laundry machines are configured to perform laundry treatment cycles (hereinafter, concisely, "treatment cycles") which typically include different phases during which laundry to be washed is subjected to corresponding treatments. A treatment cycle usually comprises at least one washing phase in which laundry to be washed is treated by means of water and a laundry detergent, followed by one or more rinsing phases. Each rinsing phase provides for treating laundry with the addition of fresh water, i.e. water taken from the main water supply, and, after the treatment is over, a draining of said water. In order to provide the laundry with beneficial properties, such as for example softness, long lasting perfume, sanitization, and/or tear resistance, it is known to add a rinse additive during one or more of the rinsing phases. For example, a laundry softener may be added during the last rinsing phase.

For these purposes, a laundry machine typically comprises a drawer having drawer reservoirs for containing one or more laundry treatment agents (hereinafter, concisely, "treatment agents") comprising, among the others, laundry detergents and laundry softeners.

In the present disclosure, by "laundry detergent" it is intended a chemical product adapted to be used by the laundry machine in a washing phase of a laundry treatment cycle for removing stains and dirt from the laundry load.

Moreover, in the present disclosure, by "laundry softener" it is intended a chemical product adapted to be used by the laundry machine in a rinsing phase of a laundry treatment cycle subsequent to the washing phase for treating the laundry load in order to soften and relax the textile fibres or composition thereof, contributing to their preservation over time.

Standard laundry machines are equipped with a drawer usually comprising at least two drawer reservoirs each one adapted to contain a single dose of a respective treatment agent for performing a single treatment cycle. For example, a first mono-dose reservoir may be arranged to contain a single dose of a laundry detergent, and a second mono-dose reservoir may be arranged to contain a single dose of a laundry softener.

In an increasingly common type of laundry machine, the drawer comprises one or more reservoirs each one adapted to contain multiple doses of a respective treatment agent for performing multiple treatment cycles (hereinafter referred to as multi-dose reservoirs) by means of an auto-dosing system that is designed to dispense a metered amount of treatment agent to perform a treatment cycle. Just as an example, in case of two multi-dose reservoirs, a multi-dose reservoir may be arranged to contain multiple doses of a laundry detergent, whereas the other multi-dose reservoir may be arranged to contain multiple doses of a laundry softener. In this class of laundry machines, the laundry machine implements an auto-dosing functionality in which, at each treatment cycle (and when the auto-dosing functionality is activated), a predetermined amount of treatment agent (usually referred to as treatment agent dose) is automatically taken from the multi-dose reservoir(s) (e.g., by means of one or more pump devices associated therewith) and dispensed to a treatment chamber (such as a washing tub).

SUMMARY OF INVENTION

The Applicant has realized that washing machines of known type are not capable of applying softener to laundry in a satisfactory way. Indeed, Applicant has observed that laundry which has been treated in a standard washing machine with the use of laundry softener does not often benefit in full from the expected beneficial properties of the used softener.

Applicant has found that this drawback is caused by the presence of laundry detergent residuals on the laundry load which hinder a good and uniform adhesion of laundry softener to the textile fibres of the laundry load.

In view of the above, it is an object of the present invention to provide a laundry machine and a corresponding method able to overcome these, as well as other, drawbacks, and particularly it is an object of the present invention to provide a method for treating laundry in a laundry machine and a corresponding laundry machine which allow an improved benefit of the beneficial properties of laundry softener.

Applicant has found that when a laundry treatment cycle provides for the use of a laundry softener, it is advantageous to set the number of rinsing phases to be carried out to a number sufficiently high to remove from the laundry load residuals of laundry detergent which can hinder a good and uniform adhesion of laundry softener to the textile fibres of the laundry load.

An aspect of the present invention relates to a method for treating laundry in a laundry machine comprising a rotatable drum adapted to receive laundry to be treated and a washing tub enclosing said drum.

According to an embodiment of the present invention, the laundry machine comprises a water supply apparatus configured to supply water into said washing tub.

According to an embodiment of the present invention, the laundry machine comprises a control unit programmed to carry out a laundry treatment cycle.

According to an embodiment of the present invention, the laundry machine comprises a laundry treatment agent dispensing device adapted to deliver into the washing tub at least one laundry treatment agent between a laundry detergent and a laundry softener.

According to an embodiment of the present invention, said laundry treatment agent dispensing device comprises a first reservoir adapted to be at least partially filled with said laundry detergent and a second reservoir adapted to be at least partially filled with said laundry softener.

According to an embodiment of the present invention, the laundry machine comprises a control system, in signal communication with the control unit, providing a softener signal adapted to take a first value indicating that no laundry softener quantity will be delivered into the washing tub during said laundry treatment cycle, and a second value indicating that a laundry softener quantity will be delivered into the washing tub during said laundry treatment cycle.

According to an embodiment of the present invention, the method comprises performing a washing phase in which the laundry treatment agent dispensing device delivers said detergent into the washing tub.

According to an embodiment of the present invention, the method further comprises performing a number of rinsing phases wherein detergent used in the washing phase is removed from laundry by using water provided by said water supply apparatus.

According to an embodiment of the present invention, the control unit sets the number of rinsing phases to be performed according to whether the value taken by the softener signal is the first value or the second value.

According to an embodiment of the present invention, the control system sets said softener signal to the second value in response to the reception of a command input by a user.

According to an embodiment of the present invention, said command input by the user is input by the user through a user device being external to the laundry machine.

According to an embodiment of the present invention, said second reservoir comprises a multi-dose reservoir configurable to contain a number of doses of said laundry softener sufficient to carry out several laundry treatment cycles.

According to an embodiment of the present invention, the method comprises automatically drawn up from said multi-dose reservoir a corresponding dose of laundry softener and deliver it into the washing tub during said laundry treatment cycle if the softener signal takes said second value.

According to an embodiment of the present invention, the control system sets said softener signal to the second value in response to the reception of a softener presence signal indicative of the presence of said laundry softener in the second reservoir.

According to an embodiment of the present invention, said second reservoir comprises a mono-dose reservoir configurable to be manually filled with a single dose of said laundry softener sufficient for a single laundry treatment cycle.

According to an embodiment of the present invention, the control unit sets a first number of rising phases, wherein said performing a number of rinsing phases comprises performing said first number of rinsing phases if the value taken by the softener signal is equal to the first value.

According to an embodiment of the present invention, the control unit modifies said first number of rinsing phases to a second number of rinsing phases if the value taken by the softener enabling signal is equal to the second value.

According to an embodiment of the present invention, said performing a number of rinsing phases comprises performing said second number of rinsing phases if the value taken by the softener signal is equal to the second value.

According to an embodiment of the present invention, if the control unit assesses that the second reservoir does not contain laundry softener, the second number of rinsing phases is set equal to the first number of rinsing phases.

According to an embodiment of the present invention, the first number of rinsing phases is lower than the second number of rinsing phases.

According to an embodiment of the present invention, said having the control unit set a first number of rising phases or modify said first number of rinsing phases to a second number of rinsing phases if the value taken by the softener signal is equal to the second value comprises setting said first number of rinsing phases or modifying said first number of rinsing phases to the second number of rinsing phases according to one or more of the following:

- a laundry weight estimation performed in a laundry weight estimation phase;
- a laundry treatment cycle selection command set by a user in a laundry treatment cycle selection phase;
- a laundry type selection command set by a user in a laundry type input phase;
- a laundry treatment cycle duration time set by a user in a laundry treatment cycle duration time setting phase;
- a signal provided by a sensor adapted to sense the amount of detergent dispersed in water and/or the water turbidity during a rinsing phase and/or at the end thereof;
- a laundry treatment agent minimum dose selection command set by a user in a laundry treatment agent minimum dose input phase.

According to an embodiment of the present invention, during each rinsing phases the control unit controls the water supply apparatus to supply a respective amount of water into the washing tub.

According to an embodiment of the present invention, if the softener signal takes the second value and the control unit assesses that the second reservoir is lower than a predefined dose amount, the control unit controls the water supply apparatus during a last rinsing phase to supply an amount of water into the washing tub that it is lower than the amounts of water supplied by the water supply apparatus during the previous rinsing phases.

According to an embodiment of the present invention the control unit causes the laundry treatment agent dispensing device to deliver into the washing tub said laundry softener during a last rinsing phase of said number of rinsing phases if the softener signal takes the second value.

Another aspect of the present invention relates to a laundry machine comprising a rotatable drum adapted to receive laundry to be treated and a washing tub enclosing said drum.

According to an embodiment of the present invention, said laundry machine comprises a water supply apparatus configured to supply water into said washing tub.

According to an embodiment of the present invention, said laundry machine comprises a control unit programmed to carry out a laundry treatment cycle.

According to an embodiment of the present invention, said laundry machine comprises a laundry treatment agent dispensing device adapted to deliver into the washing tub at least one laundry treatment agent between a laundry detergent and a laundry softener.

According to an embodiment of the present invention, said laundry treatment agent dispensing device comprises a first reservoir adapted to be at least partially filled with said laundry detergent and a second reservoir adapted to be at least partially filled with said laundry softener.

According to an embodiment of the present invention, said laundry machine comprises a control system, in signal communication with the control unit, providing a softener signal adapted to take a first value indicating that no laundry softener quantity will be delivered into the washing tub during said laundry treatment cycle, and a second value indicating that a laundry softener quantity will be delivered into the washing tub during said laundry treatment cycle.

According to an embodiment of the present invention, said control unit is configured to perform a washing phase in which the laundry treatment agent dispensing device delivers said detergent into the washing tub.

According to an embodiment of the present invention, said control unit is further configured to perform a number of rinsing phases wherein detergent used in the washing phase is removed from laundry by using water provided by said water supply apparatus.

According to an embodiment of the present invention, the control unit is configured to set the number of rinsing phases to be performed according to whether the value taken by the softener signal is the first value or the second value.

According to an embodiment of the present invention, said second reservoir comprises a multi-dose reservoir configurable to contain a number of doses of said laundry softener sufficient to carry out several laundry treatment cycles and said laundry treatment agent dispensing device is adapted to automatically drawn from said multi-dose reservoir a corresponding dose of laundry softener and deliver it into the washing tub.

According to an embodiment of the present invention, said laundry machine further comprises a cabinet and a drawer adapted to slide with respect to the cabinet between an extracted position and a retracted position.

According to an embodiment of the present invention, the laundry treatment agent dispensing device is housed in the drawer.

According to an embodiment of the present invention, the laundry treatment agent dispensing device is housed in the cabinet outside the drawer.

According to an embodiment of the present invention, the laundry treatment agent dispensing device is in fluid communication with the cabinet.

According to an embodiment of the present invention, the laundry machine is a laundry washing machine or a combined laundry washer/dryer.

According to an embodiment of the present invention, said second reservoir comprises a mono-dose reservoir configurable to be manually filled with a single dose of said laundry softener sufficient for a single laundry treatment cycle.

According to an embodiment of the present invention, said mono-dose reservoir comprises a softener sensor in signal communication with the control system and configured to provide to the control system an indication about the presence or absence of laundry softener in the mono-dose reservoir.

According to an embodiment of the present invention, the control system is configured to accordingly set the value of the softener signal according to said indication.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
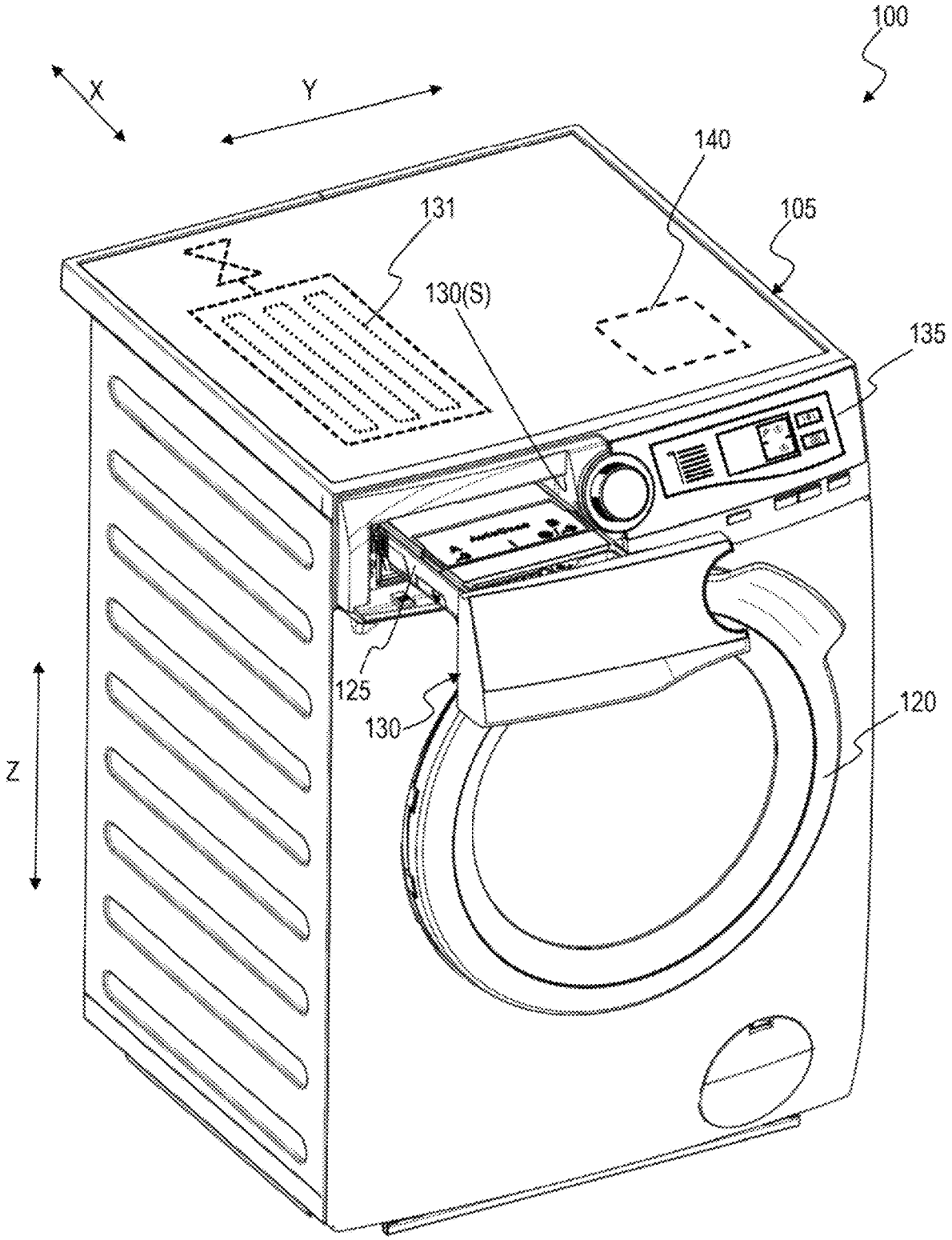
FIGS. 1A and 1B show perspective views of a laundry machine according to an embodiment of the present invention.
Figure 1B:
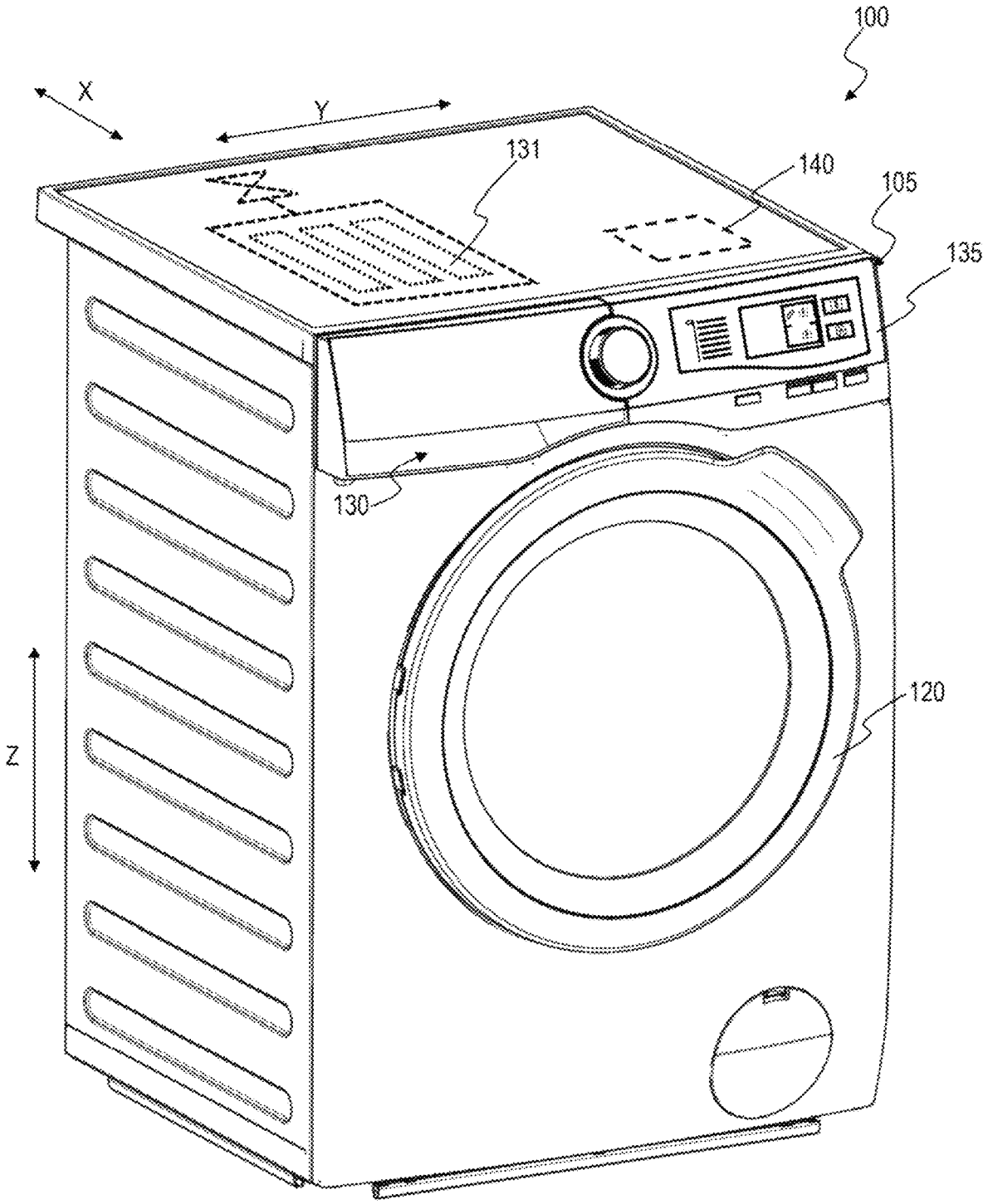

With reference to the drawings, FIGS. 1A and 1B show perspective views of a laundry machine 100 according to an embodiment of the present invention.

According to the exemplary, not limiting, embodiment herein considered, the laundry machine 100 is a laundry washing machine for treating, e.g. washing, laundry. In any case, although in the following description explicit reference will be made to a laundry washing machine, this should not to be construed as a limitation; indeed, the present invention applies to other types of laundry machines (for example combined washers/dryers, i.e. washing machines also having laundry drying functions).

The laundry machine 100 preferably comprises a number of electrical/electronic/mechanical/hydraulic components for the operation of the laundry machine 100. However, for the sake of conciseness, only components of the laundry machine 100 being relevant for the understanding of the present invention will be mentioned and discussed in the following.

The laundry machine 100 preferably comprises a (e.g., parallepiped-shaped) cabinet 105, which preferably accommodates a treatment chamber (i.e., a laundry washing chamber in the example herein considered of a washing machine) for performing a laundry treatment cycle on laundry load housed therein (e.g., a washing cycle or program in the example herein considered of a washing machine). As visible in FIG. 1C, which shows a side view of the laundry machine 100 without a side wall of the cabinet 105, the treatment chamber preferably comprises a washing tub 110 and, within it, a rotatable washing basket or drum 115 adapted to contain the laundry load to be treated (e.g., washed).

A cabinet front has a loading opening providing an access to the drum 115 for loading/unloading the laundry load, a door 120 (shown in a closed position in FIGS. 1A-1C) being provided for sealably closing the loading opening during the operation of the laundry machine 100.

The laundry machine 100 preferably comprises a laundry treatment agent dispensing device 125 (only partially visible in FIG. 1A) for dispensing treatment agent towards the washing tub 110 to be used during the selected laundry treatment cycle.

The laundry treatment agent dispensing device 125 preferably comprises one or more reservoirs ("multi-dose reservoirs") each one adapted to contain a number of doses of a treatment agent (such as washing detergents, bleaches and softeners) sufficient to carry out several laundry treatment cycles.

In other words, the laundry machine 100 is advantageously configured to implement an auto-dosing functionality in which, at each laundry treatment cycle (and, preferably, when the auto-dosing functionality is activated), an amount of treatment agent (also referred to as treatment agent dose) is automatically taken (e.g. by means of pump devices) from the multi-dose reservoir(s).

In the exemplary considered embodiment, the multi-dose reservoirs are provided in a drawer 130 of the laundry machine 100. The drawer 130 is preferably provided on a top part of the cabinet front of the laundry machine 100, and is adapted to slide within a corresponding drawer seat 130(S), along a longitudinal or sliding direction X, between an extracted position (shown in FIG. 1A) and a retracted position (shown in FIG. 1B). The sliding direction X is for example parallel to a rest surface, such as the floor, on which the laundry machine 100 preferably rests in operation (i.e., when it is installed in the user premises). In operation, the laundry machine 100 rests on the rest surface, such as the floor, and uprightly extends from it along a vertical direction Z orthogonal to the sliding direction.

According to alternative embodiments of the present invention, at least a portion of the laundry treatment agent dispensing device 125, such as for example the multi-dose reservoirs, is provided in a different section of the cabinet 105 (outside the drawer 130), or simply in fluid communication with the cabinet (such as in case the multi-dose reservoirs are external tanks located outside the cabinet and connected with the latter through external pipes).

Figure 2A:
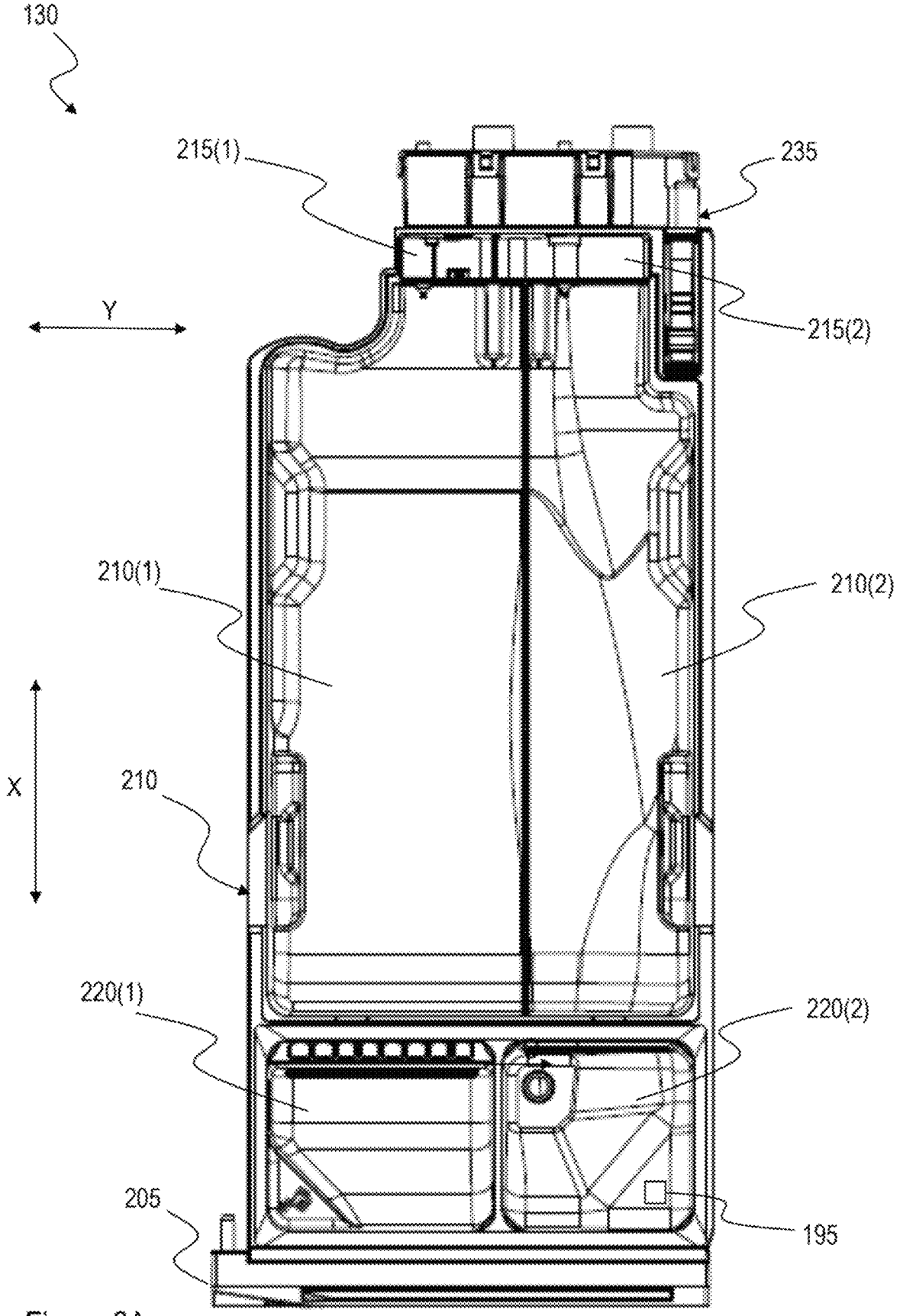
FIG. 2A is a top view of a drawer of the laundry machine according to an embodiment of the present invention.

With reference now also to FIG. 2A, it shows a top view of the drawer 130 according to an embodiment of the present invention.

The drawer 130 preferably comprises a drawer handle 205 allowing the user to slidably move the drawer 130 between the extracted position and the retracted position when it is fitted in the drawer seat 130(S), and a drawer body 210 to which the drawer handle 205 is adapted to be mounted or coupled or connected (advantageously, in a removable or reversible way). When the laundry machine 100 is installed and the drawer 130 is fitted in the drawer seat 130(S), the drawer handle 205 identifies, along the sliding direction X, a drawer front (which advantageously forms part of the cabinet front when the drawer 130 is in the retracted position).

In the exemplary considered embodiment, the drawer 130 (particularly, the drawer body 210) comprises two multi-dose reservoirs 210(1), 210(2), with the multi-dose reservoir 210(1) that may for example be configurable to contain multiple doses of a (liquid) laundry detergent and with the multi-dose reservoir 210(2) that may for example be configurable to contain multiple doses of a (liquid) softener—although this should not be construed limitatively.

The drawer 130 (particularly, the drawer body 210) preferably comprises one or more (two, in the example at issue) channels 215(1), 215(2) associated with the multi-dose reservoirs 210(1), 210(2) (in the example herein considered, each channel 215(1), 215(2) is associated with a respective one of the multi-dose reservoirs 210(1), 210(2), the channel 215(1) being for example associated with the multi-dose reservoir 210(1) and the channel 215(2) being for example associated with the multi-dose reservoir 210(2)). Each channel 215(1), 215(2) is preferably adapted to channel water and/or one or more treatment agent doses towards a region of the drawer seat 130(S) that allows a mixture between the water and the treatment agent dose(s) (hereinafter referred to as mixing region): the mixing region may for example be or comprise a bottom wall of the drawer seat 130(S) (not visible in the figures) in fluid communication with the washing tub 110.

As exemplary illustrated, the channels 215(1), 215(2) are preferably provided, along the sliding direction X, behind the multi-dose reservoirs 210(1), 210(2) (from the drawer front).

Advantageously, the channels 215(1), 215(2) (or at least one thereof) extend vertically or substantially vertically with respect to the rest surface (such as the floor) on which the laundry machine 100 rests in operation (the channels 215(1), 215(2) thus extending substantially along the vertical direction Z), thereby allowing the treatment agent dose(s) (and advantageously water from a water supply apparatus, as better discussed below) to fall towards the mixing region of the drawer seat 130(S) by gravity; in order to achieve it, each channel 215(1), 215(2) advantageously comprises a top channel input for receiving the water from the water supply apparatus, and a bottom channel output facing the bottom wall of the drawer seat 130(S); in operation, the bottom channel outputs of the channels 215(1), 215(2) are arranged for delivering the water and the treatment agent dose(s) to the bottom wall of the drawer seat 130(S), and hence to the washing tub 110.

According to an embodiment of the present invention, the laundry treatment agent dispensing device 125 also comprises one or more (e.g. two) drawer reservoirs each one adapted to contain a single dose of a respective treatment agent for performing a single treatment cycle.

For this purpose, in the exemplary considered embodiment, the drawer 130 also comprises one or more (e.g. two) drawer reservoirs 220(1), 220(2), preferably provided between the drawer handle 205 and the multi-dose reservoirs 210(1), 210(2) along the sliding direction X, and each one adapted to contain a single dose of a respective treatment agent for performing a single treatment cycle (hereinafter referred to as mono-dose reservoirs 220(1), 220(2)).

For example, the mono-dose reservoir 220(1) may be arranged to contain a single dose of a powder or liquid laundry detergent, whereas the mono-dose reservoir 220(2) may be arranged to contain a single dose of a powder or liquid or pearl laundry softener.

The laundry machine 100 also comprises pump devices (such as peristaltic pump devices, for example fixed-flow or variable-flow peristaltic pump devices) adapted to draw up treatment agent doses from the multi-dose reservoirs 210(1), 210(2), with each pump device that is preferably associated with a respective multi-dose reservoir 210(1), 210(2). In the example herein considered of two multi-dose reservoirs 210(1), 210(2), two pump devices each one for drawing up treatment agent doses from a respective multi-dose reservoir 210(1), 210(2) are provided, each dose being adapted to be used for a corresponding laundry treatment cycle. The pump devices are not visible in the figure, in that they are advantageously enclosed (at least partially) in a same case 235.

The pump devices are preferably provided behind the channels 215(1), 215(2) (from the drawer front) along the sliding direction X, and each one comprises a respective suction side in fluid communication (e.g., through a respective suction pipe of the drawer 130) with the multi-dose reservoir 210(1), 210(2) for drawing up the treatment agent dose(s) therefrom, and a respective delivery side in fluid communication (e.g., through a respective delivery pipe of the drawer 130) with the channel 215(1), 215(2) for delivering the treatment agent dose(s) thereto.

Figure 2B:
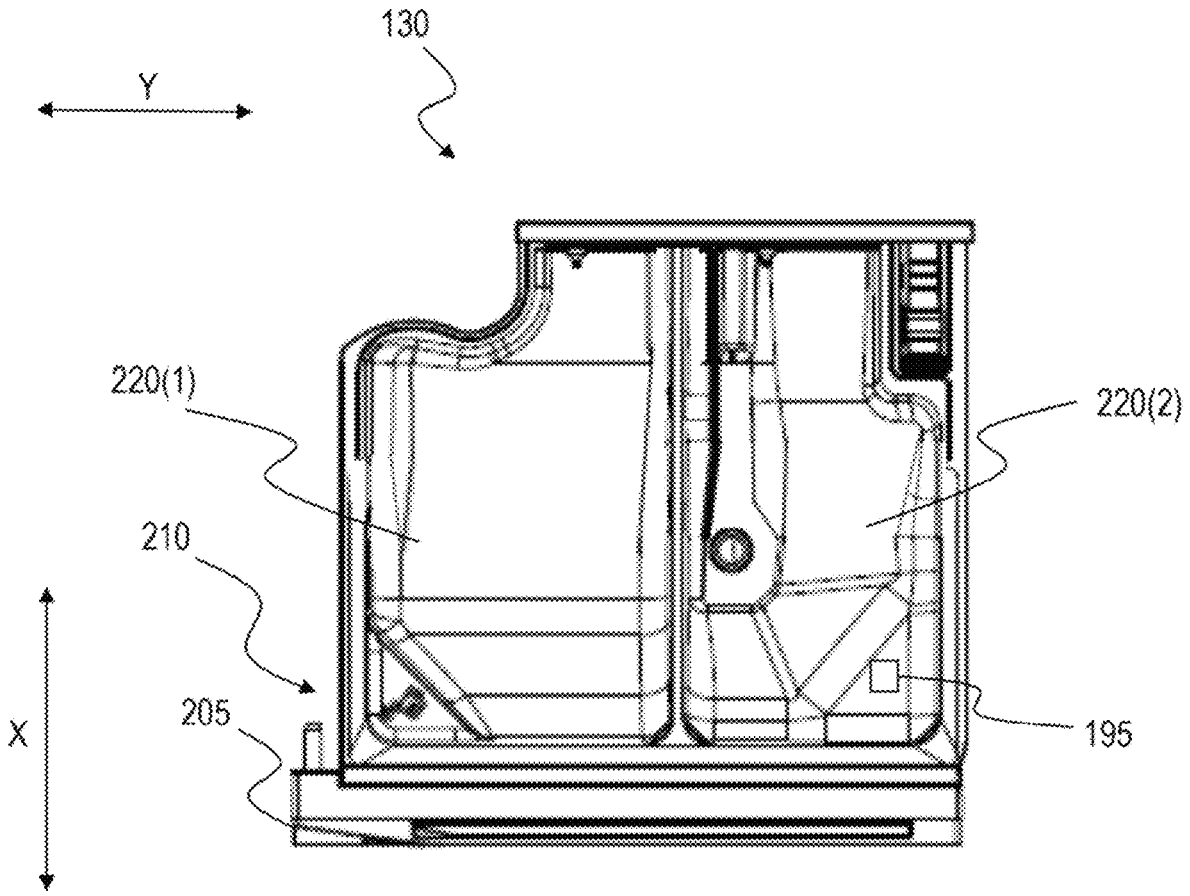
FIG. 2B is a top view of a drawer of the laundry machine according to another embodiment of the present invention.

The concepts of the present invention directly apply also to laundry machines 100 equipped with a laundry treatment agent dispensing device 125 without multi-dose reservoirs, in which the drawer 130 comprises only the mono-dose drawer reservoirs 220(1), 220(2) (as shown in FIG. 2B).

As mentioned above, the laundry machine 100 preferably comprises a water supply apparatus 131 for feeding water towards the washing tub 110 during phases of a selected laundry treatment cycle.

In the exemplary considered embodiment, the water supply apparatus 131 forms a top of the drawer seat 130(S), thus allowing the water to be fed to the channels 215(1), 215(2) (and/or to the mono-dose reservoirs 220(1), 220(2), when provided) from above. The water supply apparatus may for example comprise water conduits and electrically-controlled valves, illustrated in FIGS. 1A-1C through schematically representations thereof.

Figure 1C:
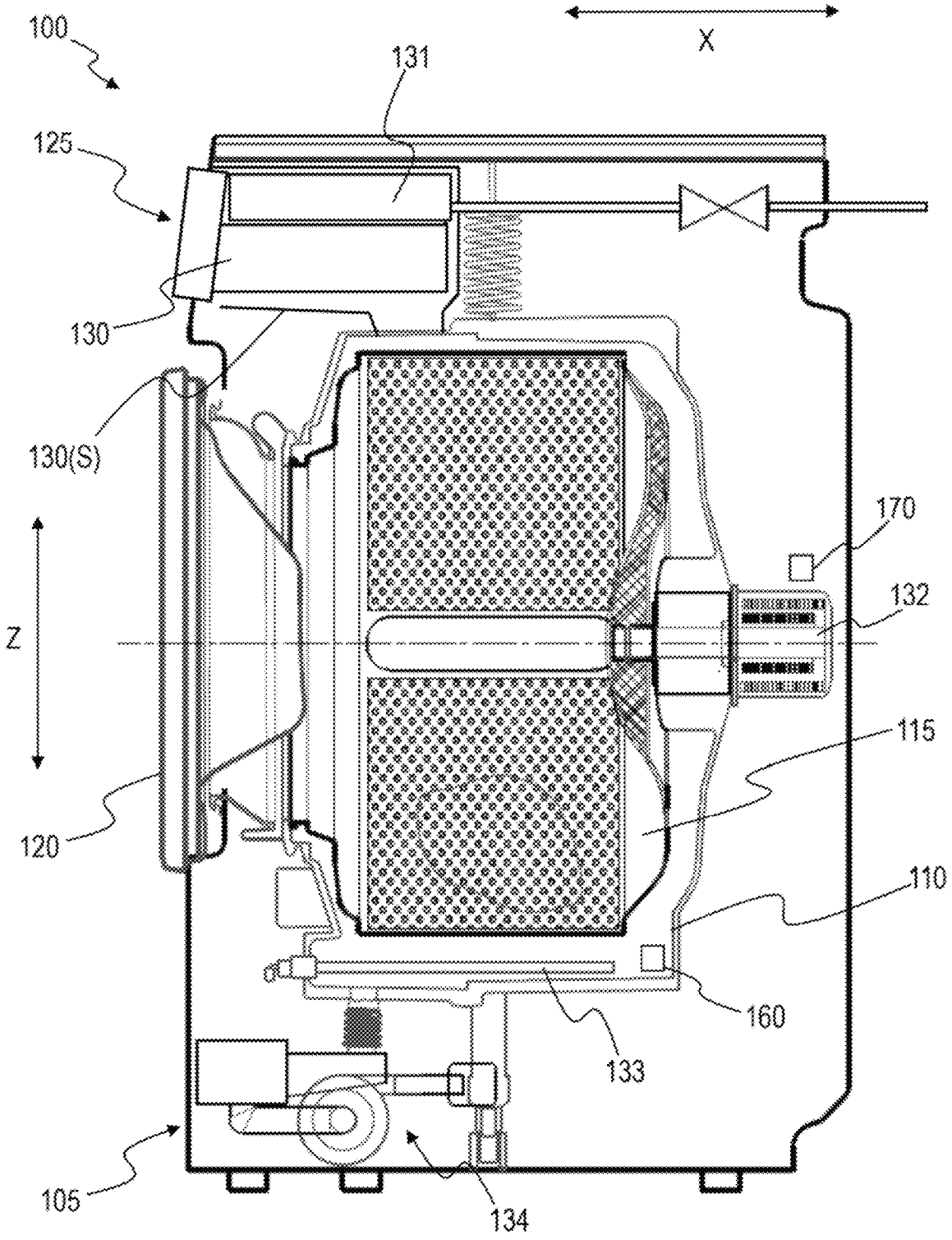
FIG. 1C is a side view of the laundry machine without a side wall of the cabinet.

In the embodiment illustrated in FIGS. 1A-1C, the water is supplied into the washing tub 110 from the water supply apparatus 131 by making it flow through the drawer 130 and then through the mixing region of the drawer seat 130(S).

The water which reached the washing tub 110 can, in this case, selectively contain one of the treatment agents contained in the reservoirs of the drawer 130. This situation corresponds to the case in which the auto-dosing functionality is activated and water is channeled through the channels 215(1), 215(2) together with a dose of treatment agent taken from a multi-dose reservoir 210(1), 210(2) (i.e., by activating the pump devices), or to the case in which the auto-dosing functionality is disabled and water is channeled through one of the mono-dose reservoirs 220(1), 220(2) containing treatment agent.

Moreover, water which reached the washing tub 110 can be clean if water is channeled through the channels 215(1), 215(2) without activating the pump devices or if water is channeled through an empty mono-dose reservoir 220(1), 220(2).

In an alternative embodiment of the invention, a separate water supply pipe (not illustrated) can be provided, which supply exclusively clean water into the washing tub 110, bypassing the drawer 130.

As illustrated in FIG. 1C, the laundry machine 100 comprises an electric motor 132 (e.g. a three-phase electric motor or a bi-phase electric motor, such as a permanently excited synchronous motor or an asynchronous motor or a brushless direct current motor or an induction motor) adapted to rotate the drum 115 within the washing tub 110. Preferably, the electric motor 132 is adapted to rotate the drum 115 at variable speeds, depending on the currently performed phase of the selected treatment cycle.

As can be seen in FIG. 1C, a heating system 133 (for example comprising a heating resistor) for heating the liquid inside the washing tub 110 is preferably provided at the bottom region of the washing tub 110.

The laundry machine 100 preferably comprises a drain apparatus 134 in fluid communication with a bottom region of the washing tub 110 and configured to withdrawn drain liquid (e.g., water possibly mixed with treatment agent and/or dirty particles) therefrom. The drain apparatus 134 is coupled with an outlet circuit (not illustrated) ending outside the cabinet 105 and, optionally, a recirculation circuit (not illustrated) adapted to recirculate the drained liquid back into the washing tub 110.

Returning back to FIGS. 1A and 1B, the laundry machine 100 preferably comprises a user interface 135, the user interface 135 being preferably provided on the top part of the cabinet front, more preferably next to the drawer seat 130(S) along a transversal direction Y orthogonal to the longitudinal X and vertical Z directions.

The user interface 135 may for example comprise a display unit (such as a light emitting polymer display (LPD), a liquid crystal display, a thin film transistor-liquid crystal display, or an organic light-emitting diode display) for visually displaying one or more pieces of information (such as information about a status of one or more components of the laundry machine 100 and/or information about a status of the treatment cycle, for example information about a residual time to the end of the ongoing treatment cycle, and/or information about a current phase of the ongoing treatment cycle, and/or selected parameters for the ongoing treatment cycle), and one or more control elements for allowing the user to select a treatment cycle and to control one or more operating parameters of the selected treatment cycle (such as, but not limited to, temperature, laundry load dirt level, spin speed, start time delay, drawer reservoir selection, selection of the type(s) of treatment agent). The control elements may for example comprise physical control elements, i.e. control elements whose activation/deactivation is associated with displacements of mechanical components (such as the rotary knob visible in FIGS. 1A-1C), and/or one or more virtual control elements, i.e. control elements whose activation/deactivation is associated with touch-sensitive electric components.

The laundry machine 100 may also comprise a connection device (not illustrated), for example a network interface controller or network adapter, for allowing a (e.g., wired or wireless) data exchange between the laundry machine 100 and an external, i.e. remote, device, for example a user device, being external to the laundry machine 100. The user device may for example be a personal digital assistant (PDA), a smartphone (as herein exemplary illustrated), a tablet, a wearable smart device (such as a smartwatch) or other mobile device having processing, input/output and memory units adapted to run software applications (i.e. mobile applications in the example at issue of a smartphone as user device).

Even if in the present disclosure reference will be explicitly made to the case in which a user is interacting with the laundry machine 100 for providing inputs/commands through the user interface 135, the concepts of the present invention directly apply to the case in which said inputs/commands are provided to the laundry machine 100 through the abovementioned user device external to the laundry machine 100.

The laundry machine 100 preferably comprises a control unit 140 for controlling the laundry machine 100 (the control unit 140 being schematically illustrated as a dashed rectangle in FIGS. 1A and 1B).

Figure 3:
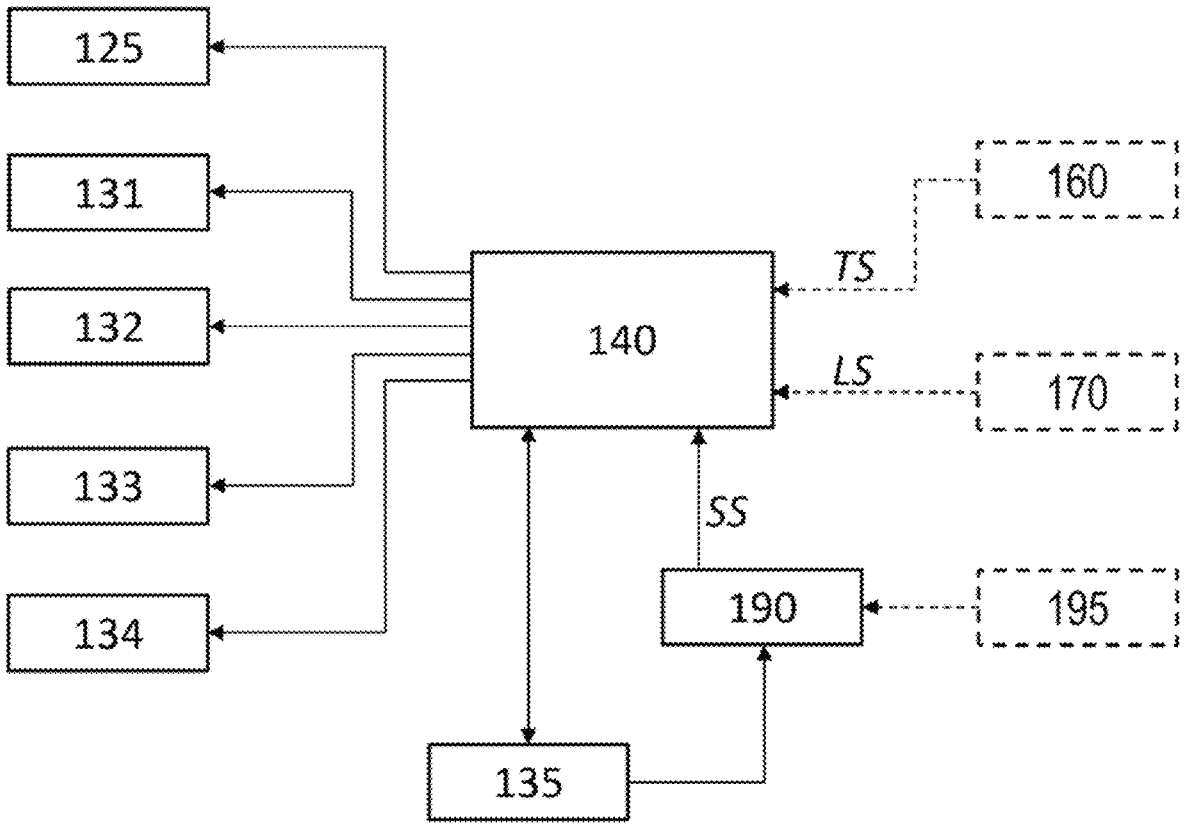
FIG. 3, illustrates some components/units/modules/apparatuses of the laundry machine in terms of functional blocks.

In order to show how the control unit 140 interacts with the laundry machine 100, reference will be now made to FIG. 3, in which some of the components/units/modules/apparatuses of the laundry machine 100 are schematically depicted through functional blocks.

The control unit 140 is coupled with the user interface 135 for receiving instructions input by the user, such as for example a selected treatment cycle and operating parameters thereof.

For the purposes of the present invention, according to the received instructions, the control unit 140 is configured to provide power and interact, during selected phases of the selected treatment cycle, with one or more of the following:

- the water supply apparatus 131 (for controlling the delivery of clean water and/or water mixed with selected treatment agents into the washing tub 110),
- the laundry treatment agent dispensing device 125 (for controlling the delivery of doses of selected treatment agents when the auto-dosing functionality is enabled),
- the heating system 133 (for setting the temperature of the water inside the washing tub 110), the electric motor 132 (for causing tumbling or spinning of the laundry load), and the drain apparatus 134 (for withdrawing liquid from the washing tub 110*d*.

Preferably, but not necessarily, the control unit 140 may be also interfaced with one or more sensor devices located in different portions of the laundry machine 100 and configured to collect data during the execution of the phases of the selected treatment cycle.

For example, the control unit 140 may be interfaced with one or more turbidity sensors 160 located in the washing tub 110 (see FIG. 1C) for receiving a turbidity signal TS indicative of an amount of laundry detergent dispersed in the water included in the washing tub 110 and/or a turbidity level of the water included in the washing tub 110.

Moreover, the control unit 140 may be interfaced with a laundry load sensor 170 for receiving a laundry load signal LS indicative of the amount (e.g., kilograms) of laundry loaded in the washing drum 115. As a non-limitative example, the laundry load sensor 170 may comprise a sensor located at the electric motor 132 (see FIG. 1C) and configured to measure electric quantities variations in the electric motor 132 induced by torque variations on the motor shaft depending on the amount of laundry load inside the washing drum 115.

Figure 4:
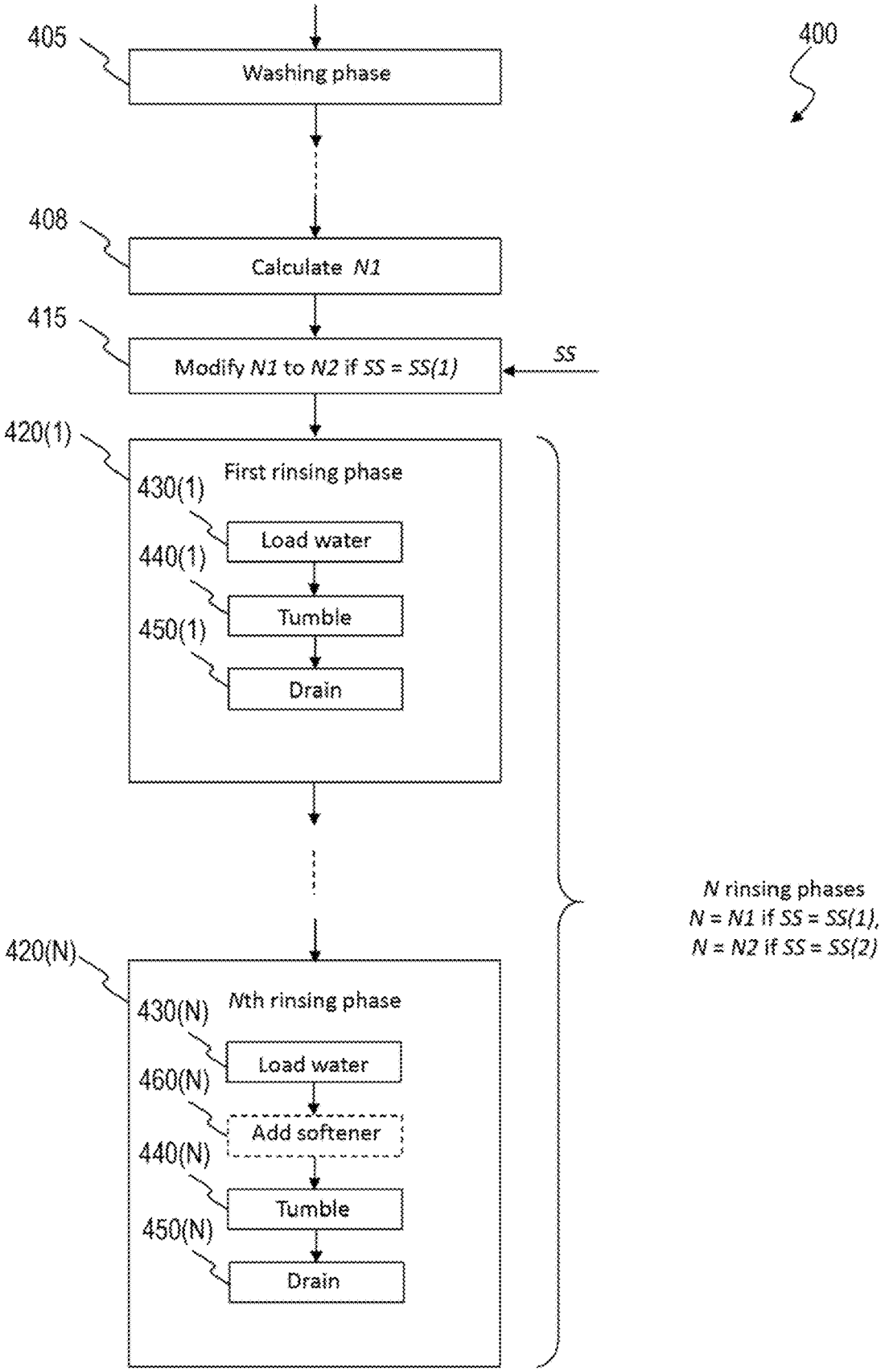
FIG. 4 illustrates a flowchart of a method for treating laundry when a selected laundry treatment cycle is carried out by the laundry machine according to an embodiment of the present invention.

FIG. 4 illustrates a flowchart 400 of a method for treating laundry when a selected laundry treatment cycle is carried out by the laundry machine 100 according to an embodiment of the present invention.

It has to be appreciated that the flow chart 400 illustrates only phases of the selected laundry treatment cycle which are relevant for the understanding of the embodiments of the invention, while other phases needed for the execution of the selected laundry treatment cycle that are well known to those skilled in the art will be neither depicted nor described for the sake of brevity.

Possible phases which can precede the phases depicted in FIG. 4 may comprise that the user loads laundry into the drum 115. Then, if the auto-dosing functionality is not activated, the user fills the mono-dose reservoir 220(1) with a dose of a laundry detergent, and, possibly, the mono-dose reservoir 220(2) with a dose of a laundry softener. If instead the auto-dosing functionality is activated, no manual filling of the mono-dose reservoirs 220(1), 220(2) is required since laundry detergent—and, possibly, laundry softener—doses are automatically drawn up from the multi-dose reservoirs 210(1), 210(2). Then, the user selects a desired laundry treatment cycle, and preferably controls one or more operating parameters thereof, through the user interface 135.

At this point, the laundry machine 100 starts to execute the selected laundry treatment cycle, such as for example with an optional pre-washing phase followed by a (main) washing phase, the latter being globally depicted in FIG. 4 with a functional block identified with reference 405. During the washing phase 405 the laundry is washed with the introduction of water and laundry detergent in the washing tub 110—by means the water supply apparatus 131 and the laundry treatment agent dispensing device 125, respectively—and tumbled by rotation of the drum 115—by means of the electric motor 132. During the washing phase 405, the water and the laundry detergent inside the washing tub 110 are preferably heated up at a proper temperature by means of the heating system 133. At the end of the washing phase 405, washing liquid (comprising water, laundry detergent and dirty particles) is advantageously drained to the outside of the laundry machine 100 by means of the drain apparatus 134.

The washing phase 405 is followed by a number N of rinsing phases directed to remove from the laundry residual of laundry detergent and/or remaining dirty particles.

According to an embodiment of the present invention, the number N of rinsing phases to be actually carried out after the washing phase 450 is set by the control unit 140 by taking into account whether or not laundry softener will be delivered into the washing tub 110 during the last rinsing phase.

More particularly, Applicant has found that when a laundry treatment cycle provides for the use of a laundry softener, it is advantageous to set the number of rinsing phases to be carried out to a number sufficiently high to remove from the laundry load residuals of laundry detergent which can hinder a good and uniform adhesion of laundry softener to the textile fibres of the laundry load.

For this purpose, according to an embodiment of the present invention, the control unit 140 is configured to set the number N of rinsing phases according to the value taken by a softener signal SS being indicative that laundry softener will be/is delivered into the washing tub 110.

According to an embodiment of the present invention, said softener signal SS is generated by a softener control system 190 in signal communication with the control unit 140 and is adapted to take a first value SS(1) and a second value SS(2), wherein:

the control unit 140 is configured to cause the laundry treatment agent dispensing device 125 to deliver into the washing tub 110 a laundry softener quantity during the laundry treatment cycle if the softener signal SS takes the second value SS(2), and the control unit 140 is configured to control the laundry treatment agent dispensing device 125 in such a way that no laundry softener quantity is delivered into the washing tub 110 during the laundry treatment cycle if the softener signal SS takes the first value SS(1).

According to an embodiment of the present invention, the softener signal SS is set to the first value SS(1) when:

the auto-dosing functionality is activated and the selected laundry treatment cycle does not provide for the use of laundry softener, or the auto-dosing functionality is activated but the user has selected through the user interface 135 an option to disable the multi-dose compartment 210(2), or the auto-dosing functionality is not activated and the mono-dose reservoir 220(2) has not been manually filled by the user with a dose of laundry softener.

According to an embodiment of the present invention, the softener signal SS is set to the second value SS(2) when at least one among the following conditions is verified:

the auto-dosing functionality is activated and the selected laundry treatment cycle provides for the use of laundry softener, the auto-dosing functionality is activated, the selected laundry treatment cycle does not provide for the use of laundry softener but the user has selected through the user interface 135 an option to enable the multi-dose compartment 210(2) for the use of laundry softener during the selected laundry treatment cycle, and the auto-dosing functionality is not activated and the mono-dose reservoir 220(2) has been manually filled by the user with a dose of laundry softener.

According to an embodiment of the present invention, the control system 190 is in signal communication with the user interface 135 (see FIG. 3) for receiving from the latter indications about the selected laundry treatment cycle, preferably together with one or more operating parameters thereof input by the user through the user interface 135, and is configured to accordingly set the value of the softener signal SS.

For example, if the auto-dosing functionality is activated and the selected laundry treatment cycle provides for the use of laundry softener, or if one of the operating parameters thereof set by the user provides for the use of laundry softener, the control system 190 sets the softener signal SS to the second value SS(2). When instead the selected laundry treatment cycle or if one of the operating parameters thereof set by the user does not provide for the delivering of a quantity of laundry softener, the control system 190 sets the softener signal SS to the first value SS(1).

In addition to or in place of the above, according to an embodiment of the present invention, the control system 190 is (also) in signal communication with a softener sensor 195 located in the mono-dose reservoir 220(2) (see FIG. 2A or FIG. 2B and FIG. 3) for receiving indications about of the presence (or absence) of a laundry softener in the mono-dose reservoir 220(2) of the drawer 130, and is configured to accordingly set the value of the softener signal SS. For example, the softener sensor 195 may be an optical sensor, a level sensor provided with floating elements, a capacitive sensor, a conductivity sensor, or an electrode-based sensor.

For example, if the auto-dosing functionality is deactivated and the user has filled the mono-dose reservoir 220(2) with a dose of laundry softener, the presence of laundry softener in the mono-dose reservoir 220(2) is detected by the softener sensor 195 and the control system 190 may automatically set the softener signal SS to the second value SS(2). If instead the auto-dosing functionality is deactivated but the mono-dose reservoir 220(2) is empty, the control system 190 may automatically set the softener signal SS to the first value SS(2).

According to an embodiment of the present invention, when the mono-dose reservoir 202(2) contains an amount of laundry softener (condition detectable by means of the softener sensor 195), the control unit 140 may ask the user to confirm (through the user interface 135) the intention of using laundry softener during the execution of the selected laundry treatment cycle.

Returning back to FIG. 4, the way the control unit 140 sets the number N of rinsing phases according to the value taken by the softener signal SS according to an embodiment of the present invention is described hereinbelow.

According to an embodiment of the present invention, the control unit 140 is firstly configured to calculate (block 408) a first (preliminary) number N1 of rinsing phases to be carried out after the washing phase 450 according to one or more of the following:

- a laundry treatment cycle selected by the user through a laundry treatment cycle selection command set by means of the user interface 135;
- an estimation of the weight of the laundry load performed in a laundry weight estimation phase (such as for example an automatic weight estimation carried out exploiting the laundry load signal LS generated by the laundry load sensor 170 or a manual weight estimation based on commands manually input by the user);
- a type of laundry load selected by the user through a laundry type selection command set by means of the user interface 135;
- a laundry treatment cycle duration time set by the user through the user interface 135;
- the turbidity signal TS generated by the one or more turbidity sensors 160;
- a minimum dose of treatment agent to be delivered by the laundry treatment agent dispensing device 125 selected by the user through a laundry treatment agent minimum dose selection command set by means of the user interface 135.

It has to be appreciated that while the calculation of the first number N1 of rinsing phases corresponding to block 408 has been described to be carried out just after the washing phase 405, similar considerations apply if said calculation is made at a different time, such as for example before the washing phase 405 itself, e.g. when the laundry treatment cycle is started.

Then, according to an embodiment of the present invention, the control unit 140 is configured to check the value taken by the softener signal SS and modify the previously calculated first number N1 of rinsing phase to a second number N2 if the softener signal SS has taken the second value SS(2), i.e., when the control unit 140 is configured to cause the laundry treatment agent dispensing device 125 to deliver into the washing tub 110 a laundry softener quantity (block 415).

According to an embodiment of the present invention, said second number N2 is advantageously equal to or higher than the first number N1 of rinsing phases. In other words, according to an embodiment of the present invention, when laundry softener is scheduled to be delivered into the washing tub 110 during a laundry treatment cycle, the control unit 140 is configured to (potentially) increase the number of rinsing phases to be carried out to a number sufficiently high to remove from the laundry load residuals of laundry detergent which can potentially hinder a good and uniform adhesion of laundry softener to the textile fibres of the laundry load.

Then, the control unit 140 is configured to cause the execution of N rinsing phases, with N=N1 if the softener signal SS has taken the first value SS(1) and N=N2 if the softener signal SS has taken the second value SS(2) (blocks 420(1)-420(N)).

According to an embodiment of the present invention, the first N−1 rinsing phases are substantially equal to each other, and for this reason only the first one (identified in FIG. 4 with reference 420(1)) will be described in detail (blocks 430(1), 440(1), 450(1)).

The rinsing phase 420(1) provides for a first sub-phase in which the control unit 140 controls the water supply apparatus 131 for feeding clean water into the washing tub 110 (block 430(1)). The clean water removes from the laundry load residual detergent and/or remaining dirty particles.

Preferably, the control unit 140 then controls the electric motor 132 to rotate the drum 115 so as to causing tumbling of the laundry load (block 440(1)). In this way, dirty water is extracted from the laundry load.

At this point, the control unit 140 controls the drain apparatus 134 to withdrawn said extracted dirty water from the washing tub 110 (block 450(1)).

The last, Nth, rinsing phase 420(N) differs from the previous N−1 rinsing phases only if a laundry softener quantity is scheduled to be delivered into the washing tub 110 (i.e., when the softener signal SS has taken the second value SS(2)). In this latter case, after a first sub-phase (block 430(N)) in which the control unit 140 controls the water supply apparatus 131 for feeding clean water into the washing tub 110, the control unit 140 controls the delivering of laundry softener into the washing tub 110 (block 460(N)), for example from the multi-dose reservoir 210(2) if the auto-dosing functionality is activated or from the mono-dose compartment 220(2) if the auto-dosing functionality is not activated. Then, the control unit 140 preferably controls the electric motor 132 to rotate the drum 115 so as to causing tumbling of the laundry load (block 440(N)) and the drain apparatus 134 to withdrawn said extracted dirty water from the washing tub 110 (block 450(N)).

If instead laundry softener is scheduled not to be delivered into the washing tub 110 (i.e., when the softener signal SS has taken the first value SS(1)), only the sub-phases 430(N), 440(N) and 450(N) of the Nth rinsing phase 420(N) are carried out.

It has to be appreciated that while the check of the value taken by the softener signal SS and the potential modification of the previously calculated first number N1 of rinsing phase to the second number N2 corresponding to block 415 has been described to be carried out just after the calculation of the first number (phase 408), similar considerations apply in case if the operations corresponding to block 415 are carried out at any time after phase 408 and before the last rinsing phase rinsing phase 420(N).

According to an embodiment of the present invention, as in the case of the first number N1 calculation, the control unit 140 may be also configured to calculate the value of the second number N2 (when the softener signal SS has taken the second value SS(2)) according to one or more among of the following:

the selected laundry treatment cycle;

the (estimation of the) weight of the laundry load;

the type of laundry load;

the duration type of the selected laundry treatment cycle;

the turbidity signal TS;

the laundry treatment agent minimum dose.

As an example of a method for treating laundry according to the flow chart 400, if the auto-dosing functionality is activated and at the same time the selected laundry treatment cycle does not provide for the delivering of a laundry softener quantity into the washing tub 110, or if one of the operating parameters set by the user does not provide for the delivering of a laundry softener quantity into the washing tub 110 (in both the two cases, the softener signal SS is set to the first value SS(1)), the control unit 140 may set a first number N1 of rinsing phases, where this first number N1 may depend on an estimation of the weight of the laundry load.

For example, if the weight of the laundry load has been estimated to be lower than a weight threshold WTH, the first number N1 is set to 2, while if the weight of the laundry load has been estimated to be higher than said weight threshold WTH, the first number is set to 3.

Then, since no laundry softener will be delivered into the washing tub 110 during said laundry treatment cycle, the control unit 140 controls the execution of a number N=N1 of rinsing cycles. In the exemplary case at issue, if the weight of laundry load has been assessed to be lower than the weight threshold WTH, the control unit 140 controls the execution of N=N1=2 rinsing cycles, while if the weight of laundry load has been assessed to be higher than the weight threshold WTH, the control unit 140 controls the execution of N=N1=3 rinsing cycles.

If instead the auto-dosing functionality is activated and at the same time the selected laundry treatment cycle provides for the delivering of a laundry softener quantity in the washing tub 110, or if one of the operating parameters set by the user provides for the delivering of a laundry softener quantity in the washing tub 110 (in both the two cases, the softener signal SS is set to the second value SS(2)), the control unit 140 may firstly set a first number N1 of rinsing phases in the same way as for the previous case—i.e., N1=2 if the weight of the laundry load has been estimated to be lower than the weight threshold WTH, and N1=3 if the weight of the laundry load has been estimated to be higher than the weight threshold WTH–, and then calculate a second number N2 starting from said first number N1. For example, if the first number N1 has been set to 2, the control unit 140 modifies said first number N1=2 to a second number N2=3 (i.e., it increases the number of rinsing phases), while if the first number has been set to 3, the control unit 140 sets said second number N2 to 3 (i.e., it confirms the number of rinsing phases previously calculated).

In other words, in case laundry softener has to be delivered into the washing tub 110, the control unit 140 acts in such a way that the number of rinsing phases that will be performed will be sufficient to favour a good and uniform adhesion of laundry softener to the textile fibres of the laundry load.

In the case in which the weight of the laundry load has been estimated to be lower than the weight threshold WTH, while a laundry treatment cycle which does not require delivering of laundry softener is normally carried out with a low number (e.g., 2) of rinsing phases (in order to avoid waste of water), according to an embodiment of the present invention such laundry treatment cycle is carried out with an increased number (e.g., 3) of rinsing phases when delivering of laundry softener is expected in order to favour a good and uniform adhesion of laundry softener to the textile fibres of the laundry load.

In the case in which the weight of the laundry load has been estimated to be higher than the weight threshold WTH, according to an embodiment of the present invention, even if delivering of laundry softener is expected, the number of rinsing phases may be not increased compared to the standard laundry treatment cycle, because the number of rinsing phases to be carried out for this case (e.g., 3) is considered to be already sufficient to favour a good and uniform adhesion of laundry softener to the textile fibres of the laundry load.

According to another embodiment of the present invention, the number of rinsing phases is always increased with respect to the first number N1 when laundry softener is scheduled to be delivered into the washing tub 110.

According to a still another embodiment of the present invention, the control unit 140 is configured not to increase the number of rinsing phases when the softener signal SS is set to the second value SS(2) (meaning that a laundry softener quantity is scheduled to be delivered into the washing tub 110) in response to a command input by the user through the user interface 135 irrespective of the actual weight of the laundry load if the control unit 140 recognizes that there is no laundry softener in neither the manual-dose reservoir 220(2) (condition recognizable through the softener sensor 195 located in the manual-dose reservoir 220(2)) nor in the multi-dose reservoir 210(2) (condition recognizable through a not illustrated softener sensor located in the multi-dose reservoir 210(2)).

In this case, the second number N2 of rinsing phase is always set equal to the first number N1 of rinsing phase, since no actual delivering of laundry softener is carried out, and therefore there is no more the reason to increase the number of rinsing phases even when the softener signal SS is set to the second value SS(2).

According to another embodiment of the present invention, if the available amount of laundry softener in the multi-dose reservoir 210(2) or in the manual-dose reservoir 220(2) is assessed to be lower than a predefined dose amount (again, these conditions can be assessed through a not illustrated softener sensor located in the multi-dose reservoir 210(2) and/or through the softener sensor 195 located in the manual-dose reservoir 220(2)), if the softener signal SS is set to the second value SS(2), the control unit 140 controls a reduction of the amount of clean water fed into the washing tub 110 by the water supply apparatus 131 during the first sub-phase 430(N) of the last, Nth, rinsing phase 420(N).

In this way, it is advantageously avoided that the (reduced amount of) laundry softener delivered in the washing tub 110 during the sub-phase 460(N) of the last rinsing phase 420(N) is not too much diluted, which instead would occur if the amount of water delivered in the washing tub 110 during the last rinsing phase 420(N) was equal to the amount of water delivered in the previous N−1 rinsing phases.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A method for treating laundry in a laundry machine comprising:

a rotatable drum configured to receive laundry to be treated;

a washing tub enclosing said drum;

a water supply apparatus configured to supply water into said washing tub;

a control unit programmed to control at least said drum and water supply apparatus to carry out a laundry treatment cycle;

a laundry treatment agent dispensing device configured to deliver into the washing tub at least one laundry treatment agent selected between a laundry detergent and a laundry softener, said laundry treatment agent dispensing device comprising a first reservoir configured to be at least partially filled with said laundry detergent and a second reservoir configured to be at least partially filled with said laundry softener, and a control system, in signal communication with the control unit, configured to provide a softener signal configured to alternately:

set a first value for the softener signal indicating that no laundry softener quantity will be delivered into the washing tub during said laundry treatment cycle upon receiving a first control input or no control input indicating that no laundry softener is to be delivered, and set a second value for the softener signal indicating that a laundry softener quantity will be delivered into the washing tub during said laundry treatment cycle upon receiving a second control input indicating that laundry softener is to be delivered;

wherein the method comprises:

performing a washing phase in which the laundry treatment agent dispensing device delivers said detergent into the washing tub; and performing a number of rinsing phases wherein detergent used in the washing phase is removed from laundry by using water provided by said water supply apparatus;

wherein the control unit sets the number of rinsing phases to be performed according to whether the value set by the softener signal is the first value or the second value.

2. The method of claim 1, wherein the second control input comprises a command input from a user interface.

3. The method of claim 2, wherein said user interface comprises a user device external to the laundry machine.

4. The method of claim 2, wherein said second reservoir comprises a multi-dose reservoir configurable to contain a number of doses of said laundry softener sufficient to carry out several laundry treatment cycles, and the method further comprises:

automatically drawing from said multi-dose reservoir a corresponding dose of the laundry softener and delivering the corresponding dose of the laundry softener into the washing tub during said laundry treatment cycle upon determining that the softener signal is set with said second value.

5. The method of claim 2, wherein said second reservoir comprises a mono-dose reservoir configurable to be manually filled with a single dose of said laundry softener sufficient for a single laundry treatment cycle.

6. The method of claim 1, wherein the second control input comprises a softener presence signal indicative of a presence of said laundry softener in the second reservoir.

7. The method of claim 1, wherein:

the control unit is configured to set a first number of rising phases, wherein said performing a number of rinsing phases comprises performing said first number of rinsing phases upon determining that the value set by the softener signal is equal to the first value, and the control unit is configured to modify said first number of rinsing phases to a second number of rinsing phases upon determining that the value set by the softener signal is equal to the second value, wherein said performing the number of rinsing phases comprises performing said second number of rinsing phases upon determining that the value set by the softener signal is equal to the second value.

8. The method of claim 7, wherein upon determining, by the control unit, that the second reservoir does not contain laundry softener, the method comprises setting the second number of rinsing phases equal to the first number of rinsing phases.

9. The method of claim 7, wherein the first number of rinsing phases is lower than the second number of rinsing phases.

10. The method of claim 7, wherein said having the control unit set a first number of rising phases, or modify said first number of rinsing phases to a second number of rinsing phases if the value set by the softener signal is equal to the second value, comprises setting said first number of rinsing phases or modifying said first number of rinsing phases to the second number of rinsing phases according to one or more of the following:

a laundry weight estimation performed in a laundry weight estimation phase;

a laundry treatment cycle selection command received by a user in a laundry treatment cycle selection phase;

a laundry type selection command received by a user in a laundry type input phase;

a laundry treatment cycle duration time received by a user in a laundry treatment cycle duration time setting phase;

a signal provided by a sensor configured to sense an amount of detergent dispersed in water and/or a water turbidity during a rinsing phase and/or at the end thereof;

a laundry treatment agent minimum dose selection command received by a user in a laundry treatment agent minimum dose input phase.

11. The method of claim 1, wherein during each of the rinsing phases, the control unit is configured to control the water supply apparatus to supply a respective amount of water into the washing tub, wherein the method further comprises:

upon determining that the softener signal is set to the second value and the control unit assesses that an amount of laundry softener contained in the second reservoir is lower than a predefined dose amount of laundry softener to be dispensed in the laundry treatment cycle, the control unit controls the water supply apparatus during a last rinsing phase to supply an amount of water into the washing tub that it is lower than an amount of water supplied by the water supply apparatus during one of the rinsing phases preceding the last rinsing phase.

12. A laundry machine, comprising:

a rotatable drum configured to receive laundry to be treated;

a washing tub enclosing said drum;

a water supply apparatus configured to supply water into said washing tub;

a control unit programmed to control at least said drum and water supply apparatus to carry out a laundry treatment cycle;

a laundry treatment agent dispensing device configured to deliver into the washing tub at least one laundry treatment agent selected between a laundry detergent and a laundry softener, said laundry treatment agent dispensing device comprising a first reservoir configured to be at least partially filled with said laundry detergent and a second reservoir configured to be at least partially filled with said laundry softener, and a control system, in signal communication with the control unit, configured to provide a softener signal configured to alternately:

set first value for the softener signal indicating that no laundry softener quantity will be delivered into the washing tub during said laundry treatment cycle upon receiving a first control input or no control input indicating that no laundry softener is to be delivered, and set a second value for the softener signal indicating that a laundry softener quantity will be delivered into the washing tub during said laundry treatment cycle upon receiving a second control input indicating that laundry softener is to be delivered;

wherein the control unit is configured to:

perform a washing phase in which the laundry treatment agent dispensing device delivers said detergent into the washing tub; and perform a number of rinsing phases wherein detergent used in the washing phase is removed from laundry by using water provided by said water supply apparatus;

wherein the control unit is configured to set the number of rinsing phases to be performed according to whether the value set by the softener signal is the first value or the second value.

13. The laundry machine of claim 12, wherein said second reservoir comprises a multi-dose reservoir configurable to contain a number of doses of said laundry softener sufficient to carry out several laundry treatment cycles and said laundry treatment agent dispensing device is configured to automatically draw from said multi-dose reservoir a corresponding dose of said laundry softener and deliver said corresponding dose of said laundry softener into the washing tub.

14. The laundry machine of claim 13, further comprising a cabinet and a drawer configured to slide with respect to the cabinet between an extracted position and a retracted position, wherein:

the laundry treatment agent dispensing device is housed in the drawer, or the laundry treatment agent dispensing device is housed in the cabinet outside the drawer, or the laundry treatment agent dispensing device is in fluid communication with the cabinet.

15. The laundry machine of claim 12, wherein:

said second reservoir comprises a mono-dose reservoir configured to be manually filled with a single dose of said laundry softener sufficient for a single laundry treatment cycle;

said mono-dose reservoir comprises a softener sensor in signal communication with the control system and configured to send the first control input or the second control input to the control system based on an indication about the presence or absence of laundry softener in the mono-dose reservoir.

* * * * *